United States Patent [19]

Geiger et al.

[11] Patent Number: 4,544,284

[45] Date of Patent: Oct. 1, 1985

[54] LEAKPROOF WATCH CASE

[75] Inventors: Michel Geiger, La Neuveville; Gaston Gagnebin, Bienne; Jacques Ackermann, La Chaux-de-Fonds, all of Switzerland

[73] Assignee: Omega SA, Bienne, Switzerland

[21] Appl. No.: 612,828

[22] Filed: May 22, 1984

[30] Foreign Application Priority Data

May 25, 1983 [CH] Switzerland ..... 2848/83

[51] Int. Cl.[4] ..... G04B 37/00

[52] U.S. Cl. ..... 368/294; 368/309

[58] Field of Search ..... 368/88, 276, 281–282, 368/285, 287, 291–296, 299–300, 309

[56] References Cited

U.S. PATENT DOCUMENTS 3,910,031 10/1975 Keida ..... 368/281
4,390,288 6/1983 Arnoux ..... 368/276
4,417,821 11/1983 Herchenbach ..... 368/291
4,440,505 4/1984 Gogniat ..... 368/292

FOREIGN PATENT DOCUMENTS 1093310 5/1955 France ..... 368/282
591109 12/1976 Switzerland ..... 368/282

*Primary Examiner*—Vit W. Miska
*Attorney, Agent, or Firm*—Griffin, Branigan & Butler

[57] ABSTRACT

A wrist-watch case includes a back that is screwed onto a spacer ring and an assembly of two caps and a crystal that forms one piece attached to the case-band by screws fastened into the caps from the underside of the case-band. This construction makes it possible to integrate a bracelet perfectly with the case through the caps, each cap forming an end link having the same appearance as the articulated links of the bracelet and adjoining the beveled edge of the crystal. This construction is particularly well adapted to the use of caps and links made entirely of hard metal.

7 Claims, 2 Drawing Figures

LEAKPROOF WATCH CASE

BACKGROUND OF THE INVENTION

The present invention relates to a wrist-watch comprising a case-band, a crystal cut to lie flush with the outer circumference of the flat, upper surface of the case-band (said outer circumference coincinding with the edge of the case at 3:00 o'clock and 9:00 o'clock), a spacer ring resting on an inner ledge of the center to support the movement, and a screw-fastened back.

Wrist-watch cases are known in which the edges of the crystal lying at 3:00 o'clock and 9:00 o'clock coincide with the edge of the case. Such a construction is shown, for example, in Swiss patent 592,911, in which FIG. 3 shows a crystal 3 lying flush with the case-band 2. The crystal is inserted at 6:00 o'clock and 12:00 o'clock into the parallel slides formed in a piece of the case, where it is held in place by a seal gasket that it compresses against its inner surface. This design has several drawbacks, the first being the fact that the crystal is inserted into slides. In addition to the fact that the presence of the gasket makes this difficult, the operation may damage any decoration one might wish to place on the crystal. A second disadvantage resides in having two band-attachment pieces that are difficult to produce (or even impossible if the pieces are to be made of a hard metal) and whose system for attachment to the case-band results in a very protuberant arrangement that is difficult to integrate with a bracelet if the pieces in question are to form the end links of such a bracelet. A third drawback lies in not having a removable back to provide access which, in the case of an electronic watch is necessary for periodically changing the battery.

SUMMARY OF THE INVENTION

An object of the present invention is to provide a watch case constructed so that the bracelet made of links can be perfectly integrated with the case itself while simultaneously providing for easy assembly and removal not requiring an excess of precaution.

In accordance with the principles of the present invention a wrist-watch case comprises a case-band, a crystal cut to lie flush with the outer circumference of the flat upper surface of the case-band, the outer circumference coinciding with the edge of the case at three and nine o'clock, a spacer ring resting on an inner ledge of the case-band to support the movement, and a screwfastened back. The case includes a removable assembly comprising the crystal and two caps located at six and twelve o'clock with the caps being positioned upon a second ledge of the case-band and held in place by screws. The crystal has beveled edges at six and twelve o'clock. The caps extend from the case-band to form end links to which a bracelet of articulated links may be attached.

BRIEF DESCRIPTION OF THE DRAWINGS

The invention will be understood in light of the following description and the accompanying illustrative drawings which illustrate a preferred embodiment of the invention in which.

DETAILED DESCRIPTION OF THE INVENTION

Figure 1:
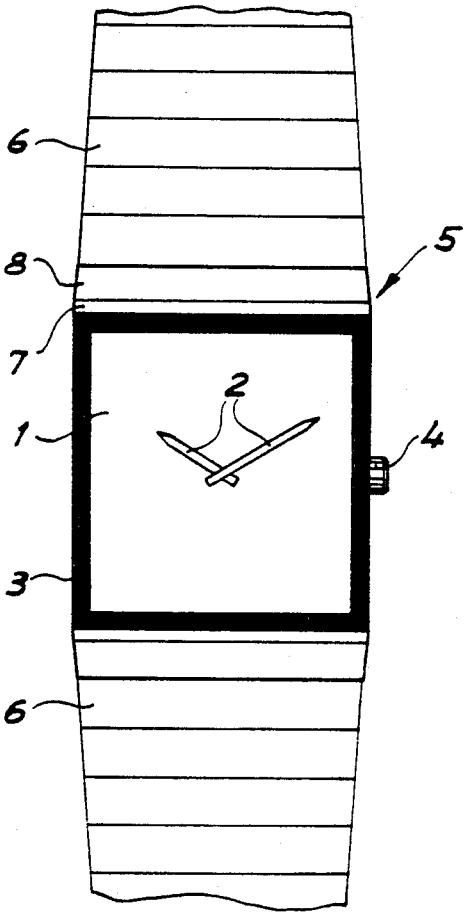
FIG. 1 is a top view of the watch case and attached bracelet of the present invention; and, FIG. 2 is a larger-scale cross-section of the case of FIG. 1 taken along the 6:00 o'clock–12:00 o'clock axis.

FIG. 1 is a top view of the watch of the invention. Through a crystal 1 can be seen the display, represented by two hands 2. The underside of the crystal is decorated with a border 3. The border is generally metallized, to conceal the upper surface of a case-band, seal gasket, and (elevating) spacer. On the right side of the which is a device 4 for setting the time. It will be seen that the edges of the crystal are each juxtposed with an end link 5 of a bracelet 6. The visible upper part of end link 5 comprises a flat portion 7 aligned with the plane of the crystal and an inclined portion 8. The inclined portion may be equipped with a hinge (not shown) to attach it to the first movable link of bracelet 6.

Figure 2:
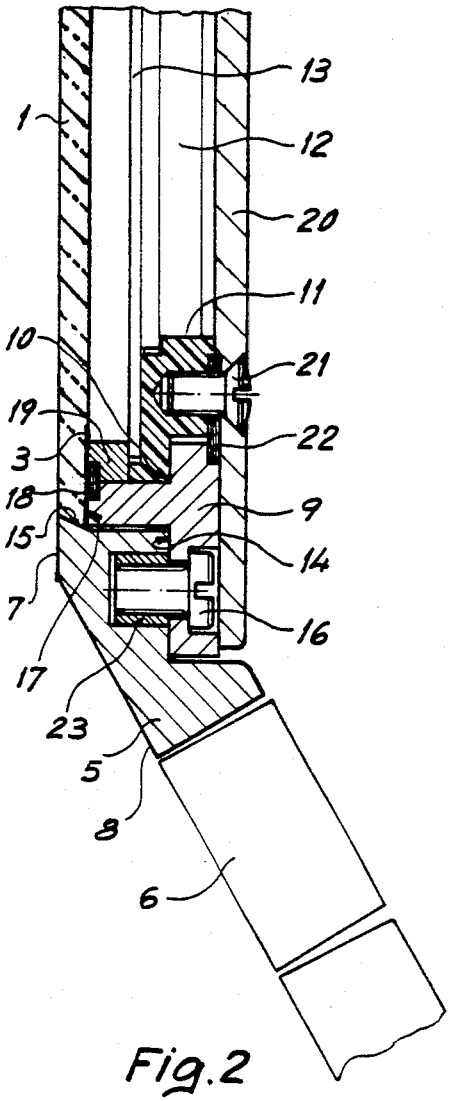

The manner in which the watch case is produced and assembled under the invention will now be demonstrated with reference to FIG. 2. The case comprises a case-band 9 having two ledges. Inner 10 is designed to hold a spacer ring 11 that in turn holds movement 12, which is fastened to the ring by means of flanges that are not shown. A second, outer ledge 14 is also fashioned in case-band 9. Onto this ledge is placed and fastened a cap 5 forming the end link discussed with reference to FIG. 1. This cap has the flat 7 and inclined 8 portions mentioned above and extends from the case-band to fit in with the bracelet 6 itself. A bevel 15 is ground along the edge of crystal 1 and cap 5 is fastened to the crystal at the location of this bevel by appropriate means, e.g., welding or cementing.

Crystal 1 and the two caps 5 (of which only one appears in the drawing) thus form under the invention a removable preassembly that can be attached to the case or separated from it for maintenance or repair. The assembly in question is fastened to the case-band by means of screws 16 arranged in pairs, with one located at 6:00 o'clock and the other at 12:00 o'clock. To seal the case, a seal gasket 18 is placed between crystal 1 and the flat upper surface 17 of the case-band. This gasket is compressed by the crystal when screws 16 are tightened. The heads of screws 16 are applied against the bottom of the case-band and the screws 16 are screwed directly into a blind threaded hole in the cap. When the cap is made of a hard substance, as discussed below, the blind holes are equipped with threaded sleeves 23 to hold the screws. The embodiment of FIG. 2 also shows a floating spacer 19 that holds dial 13 in place. In this embodiment, a notch is made in both the case-band and the spacer to house seal 18. To hide surface 17, seal 18, and spacer 19, the underside of the crystal is decorated with a border 3 that can be better seen in FIG. 1.

The case also comprises a removable back 20. In accordance with the invention, this back is not screwed into the case-band, as is usually the case, but into spacer ring 11. If the case is shaped, this ring will advantageously be made of plastic and provided with threaded metal sleeves (not shown) to hold screws 21 arranged in pairs on either side of the case. A gasket 22 seals the back of the case. It will be noted that this method of fastening the back helps achieve the aesthetic appearance sought here because it make it possible to reduce the width 8 of end link 5 (considered in the direction of the length of the bracelet) to the width of the other articulated links of the bracelet.

The various phases in the assembly of the watch will now be described, making use of the above description. Movement 12 is fastened to ring 11 by means of flanges that are not shown. This subassembly is inserted then into case-band 9 from above. Spacer 19 and seal 18 are put in place. A cap 5 is cemented to each side of crystal 1 and the assembly thus formed is fastened to case-band 9 by means of screws 16. Back 20 is then attached to the case with screws 21.

The advantage of such an assembly is apparent. When the battery must be replaced, the back is simply removed. This easy access is not provided by so-called unibody cases in which the back is of a piece with the center, as in the construction that is the subject of Swiss patent No. 592,911 referred to above. In addition, if the movement itself must be accessed, one simply removes the assembly composed of crytsal 1 and the two caps 5. Because it forms one piece, this assembly may be replaced with precision, without risking damage to the metallized border 3 or seal 18, as would be the case if the crystal has to be inserted into a slide as taught by the Swiss patent.

It should also be mentioned that fastening by screws as contemplated here avoids any deformation to which the watch case might be subject if the fastening were accomplished by means of catches. Fastening caps 5 from the bottom of the case-band also makes it possible to reduce the width of metallized border 3 to a minimum and leave a maximum of surface for the watch dial. In fact in this construction the flat, upper surface 17 of the case-band has the same shape as the circumference of the crystal and is free of screws, which would have to be concealed with a wider metallized area.

Generally, the construction proposed here results in the perfect integration of the bracelet with the watch case since the end link of the bracelet is brought up to the very edge of the crystal without any apparent fastenings and the articulated links extending from it are aligned with it without any discontinuity. The fact that the width 8 of end link 5 is essentially the same as the width of the other links 6 has already been pointed out.

End link 5 and articulated links 6 may be made of any suitable material that can be applied to a watch. However, it will be noted that the construction as described lends itself particulary well to the use of a substance with a hardness exceeding 1,500 Vickers, such as tungsten carbide, titanium, or even cement. The shape of the cap 5 forming the end link is very simple, having no hollows that would make it difficult to machine. The cap may be made entirely from a hard substance, like the articulated links extending from it, resulting in a piece with a new aesthetic appearance distinguished from the hard-metal wrist-watch known to date, in which the bracelet links of ordinary material have served to support small plates of hard metal.

The invention is not limited to a watch having the square crystal shown in FIG. 1. It may be applied to rectangular or polygonal shapes. A similar construction may be used for a round crystal. In this case, caps 5 would have a semi-circular joint with the crystal.

While a preferred embodiment of the invention has been described in specific detail it will be understood that various modifications and substitutions may be made in the described embodiment without departing from the spirit and scope of the invention as defined by the appended claims.

We claim:

1. A wrist-watch case comprising a case-band having a flat upper surface, a crystal cut to lie flush with the outer circumference of the flat upper surface of the case-band, said outer circumference coinciding with the edge of the case at two opposed portions of said edge, a spacer ring resting on an inner ledge of the case-band to support the movement, and a screw-fastened back, characterized by the fact that said case includes a removable assembly which comprises two caps and the crystal, said crystal having two opposed beveled edges with each of said caps abutting a respective one of said beveled edges, each of said caps being positioned upon a second, outer ledge of the case-band and held in place with screws, said caps extending from the case-band to form end link to which a bracelet of articulated link may be attached.

2. A wrist-watch case as claimed in claim 1, wherein the circumference of the crystal is four-sided.

3. A wrist-watch case as claimed in claim 1, wherein the crystal is round.

4. A wrist-watch case as claimed in claim 1, wherein a bracelet is attached to said caps forming said end links, said bracelet and said caps being made entirely of material having a hardness of at least 1,500 Vickers.

5. A wrist-watch case as claimed in claim 2, wherein the width of an end link, considered in the direction of the length bracelet, is essentially the same as the width of the links making up the bracelet.

6. A wrist-watch case as claimed in claim 2, wherein the spacer ring is made to house screws to hold the back of the case.

7. A wrist-watch case as claimed in claim 1, wherein each of the beveled edges of the crystal is cemented onto the corresponding cap.

* * * * *